US005652957A

United States Patent [19]

Williford et al.

[11] Patent Number: 5,652,957

[45] Date of Patent: Aug. 5, 1997

[54] SAFETY-WEAR FOR ROOF INSTALLERS

[76] Inventors: Glenn P. Williford, Rte. 2, Box 63-A; James H. Oliver, 901 E. Bowie, both of Mexia, Tex. 76667

[21] Appl. No.: 536,827

[22] Filed: Sep. 29, 1995

Related U.S. Application Data

[63] Continuation-in-part of Ser. No. 383,567, Feb. 3, 1995, abandoned.

[51] Int. Cl.[6] ..... A41D 13/00

[52] U.S. Cl. ..... 2/22; 2/214; 2/242

[58] Field of Search ..... 2/2, 2.5, 22–24, 2/46–48, 51, 62, 69, 214, 215, 227, 228, 238, 242, 908, 911, 919, 920; 602/19

[56] References Cited

U.S. PATENT DOCUMENTS

| | | | |
|---|---|---|---|
| D. 201,861 | 8/1965 | Cummins | 2/22 X |
| 1,136,307 | 4/1915 | Bourdon | 2/2 |
| 1,254,808 | 1/1918 | Jones | 2/2 |
| 1,404,987 | 1/1922 | Lundqvist | 2/51 |
| 2,446,006 | 7/1948 | Hendricks | 2/2 |
| 4,837,859 | 6/1989 | Hamberg | 2/2 |
| 5,052,052 | 10/1991 | Gilford et al. | 2/2 |
| 5,241,706 | 9/1993 | Netz | 2/46 |

*Primary Examiner*—C. D. Crowder
*Assistant Examiner*—Gloria Hale
*Attorney, Agent, or Firm*—Timmons & Kelly; W. Thomas Timmons; Daniel Rubin

[57] ABSTRACT

Multi-section safety apparel used by a workman installing or repairing steep sloped roofing for effecting a reduced coefficient of sliding friction between the workman and the roof surface. The first section is comprised of a coarse textured layer of foam rubber or high density polyurethane foam adapted for a wrap installation about at least the buttocks and rear of the wearer's thighs. Additional sections attachable to the first section, are available for optionally protecting also the calfs and knees of the wearer while a hammer loop and nail pouch are available for detachable attachment to the first section.

18 Claims, 5 Drawing Sheets

SAFETY-WEAR FOR ROOF INSTALLERS

This application is a continuation-in-part of application Ser. No. 08/383,567 filed Feb. 3, 1995, now abandoned.

FIELD OF THE INVENTION

The field of art to which the invention relates, comprises improvements in protective wear apparel affording enhanced safety and surface grip when worn by a workman while installing or repairing a pitched roof.

BACKGROUND OF THE INVENTION

New or old construction, and dwelling construction in particular, commonly utilize a sloping roof having a pitch of up to about a 12-on-12. The undersurface of the roof is typically of a smooth plywood composition while the finished roof overlies the plywood generally in the form of composition shingles or tile. Whatever the materials, the roof installer, usually on his knees or semi-seated, is confronted with steep angle slopes on which he must secure himself many times in the course of installation. To avoid slippage and/or falling, extreme caution must be exercised on the part of each individual workman to minimize, if not eliminate, the possiblity of injury. Safety, is of course paramount, but the added caution is per se time consuming such that it indirectly contributes to increased labor costs resulting from decreased productivity.

To a large extent, roofers have just coped with the problem relying on heavy clothing and/or the exercise of caution. It has long been recognized however, that enhanced roof safety could not only reduce injury but at the same time result in increased productivity affording a previously unheard of economic benefit.

OBJECTS OF THE INVENTION

It is therefore an object of the invention to provide novel slip preventive protective wear for a workman while installing or repairing a sloping roof.

It is a further object of the invention to effect the previous object with a form of protective over-clothing that enhances a worker's grip when working on a sloping roof.

It is a still further object of the invention to effect the previous objects with protective wear that is available in attachable sections so as to be readily selected and assembled in various combinations by the workman for use on site.

SUMMARY OF THE INVENTION

This invention relates to novel safety wear to be worn by a workman when installing or repairing a sloping roof. More specifically, the invention hereof relates to safety wear allowing a workman on a sloping roof to better grip the roof surface with their legs and buttocks and thereby aid in preventing dangerous slips and falls. As a result of such wear, the hazard of working on a sloping roof is significantly reduced thereby affording enhanced security while enabling individual productivity to be increased.

The foregoing is achieved in accordance with one embodiment of the invention by wearing apparel adapted for use over existing clothing to be slipped over the legs and about at least the back and side portions of the wearer's buttocks. Appearing as a pair of reinforced shorts, the span of the apparel is comprised of a one-half to two inch thick, soft, resilient, but coarse textured padding such as foam rubber with nylon edging and/or high density polyurethane foam. The crotch is made of nylon while belts, buckles and/or VELCRO hook and loop fastener enable the apparel to be secured in place on the workman.

Attachments are available as individual separate sections for extending the first buttocks section to about the calfs and knees. The attachment sections are formed of similar composition that are attached to the first section by straps or VELCRO fasteners. Extra padding may be provided about the waist area for increased back support. Likewise, a nail pouch and/or hammer loop comprising tool totes can conveniently be detachably attached about waist high to the first section by velcro or the like. She first and separate sections along with the tool totes can be packaged and marketed as a kit affording assembly in various combinations with any or all of the components selected at the time of use.

In an alternative embodiment, the various sections can be supported on the workman by a shoulder harness that is adjustable to fit and which sections support detachable pads of similar composition as above.

The above noted features and advantages of the invention as well as other superior aspects thereof will be further appreciated by those skilled in the art upon reading the detailed description that follows in conjunction with the drawings.

DESCRIPTION OF THE PREFERRED EMBODIMENT

Figure 1:
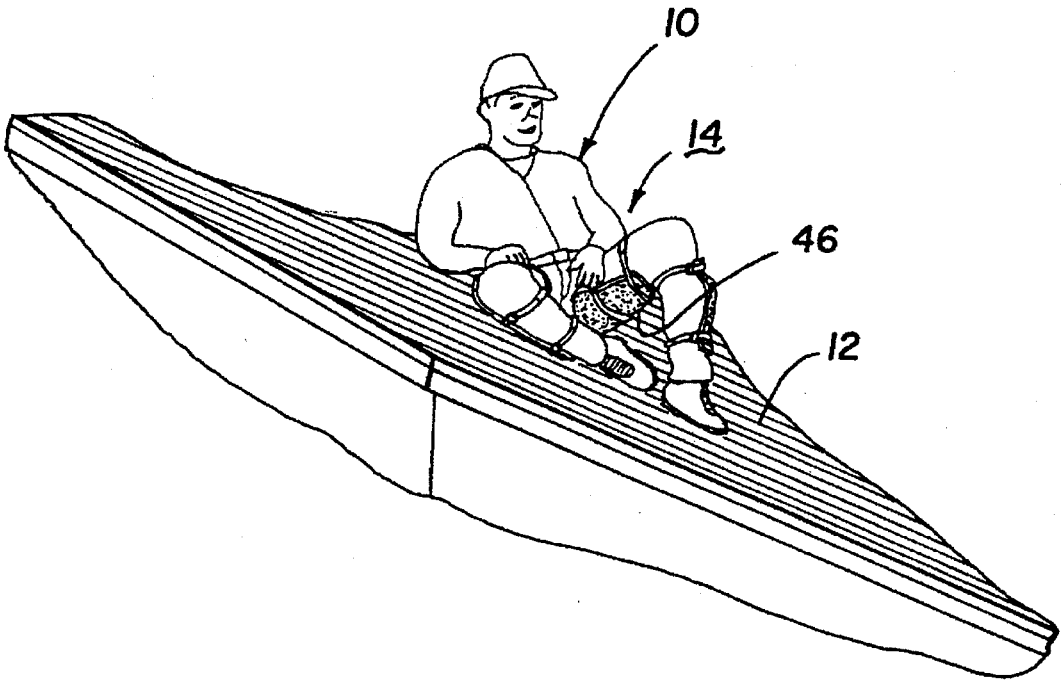
FIG. 1 illustrates a workman wearing a first embodiment of the apparel hereof while working on a sloping roof.
Figure 2:
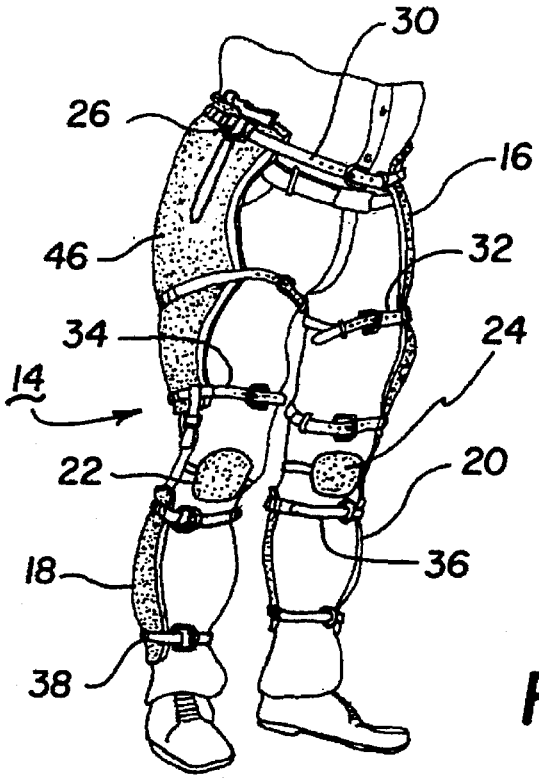
FIG. 2 is an isometric front elevation of a workman on which all sections of the safety apparel FIG. 1 are utilized.
Figure 3:
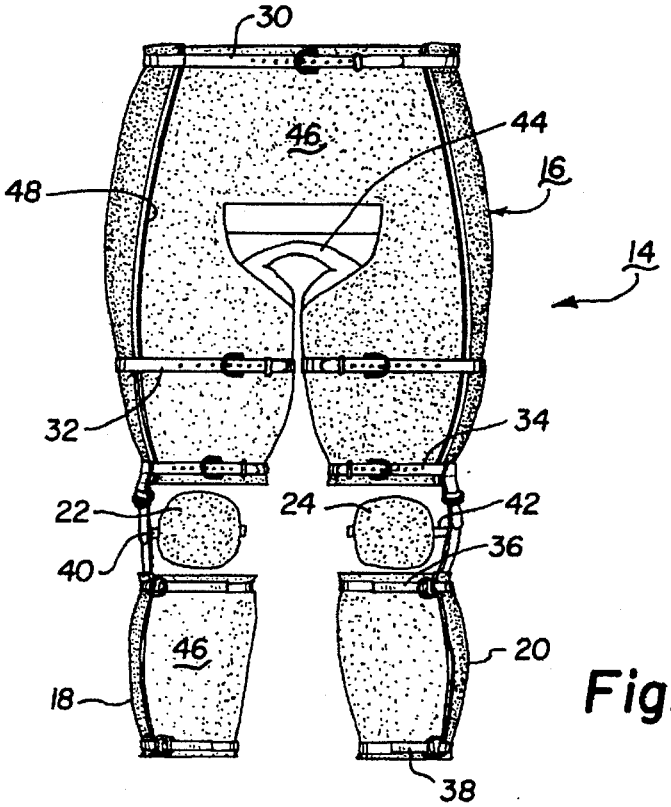
FIG. 3 is a front elevation of the apparel hereof corresponding to FIG. 2.
Figure 4:
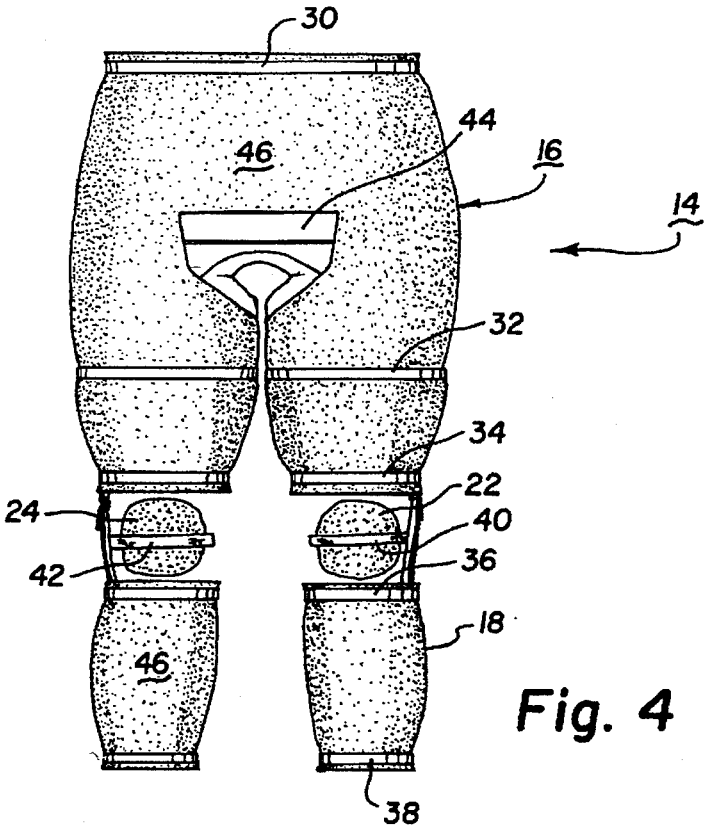
FIG. 4 is a rear elevation of the apparel hereof corresponding to FIG. 3.
Figure 5:
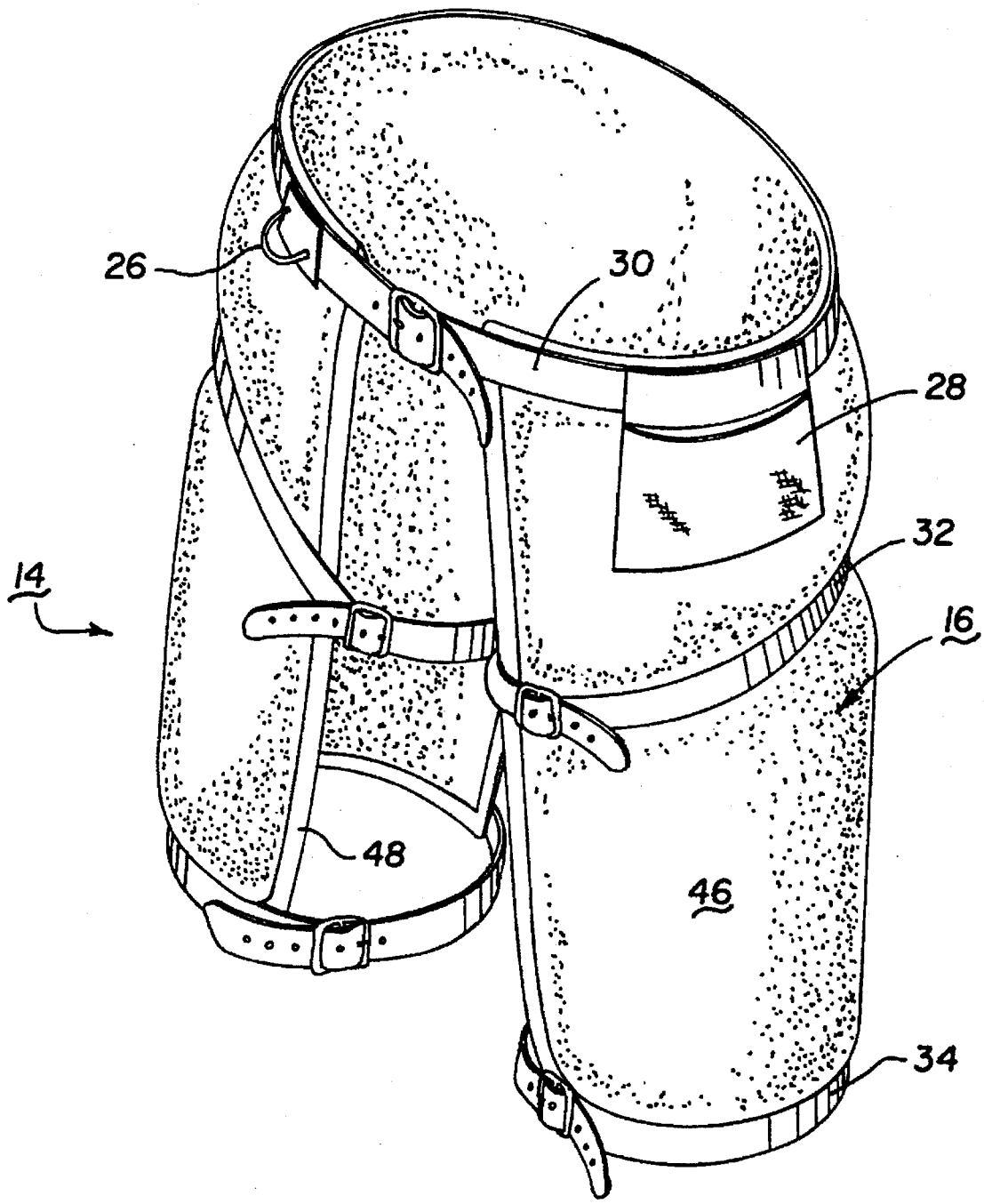
FIG. 5 is an isometric elevation of the buttocks section of the apparel of FIG. 2 when used alone.
Figure 6:
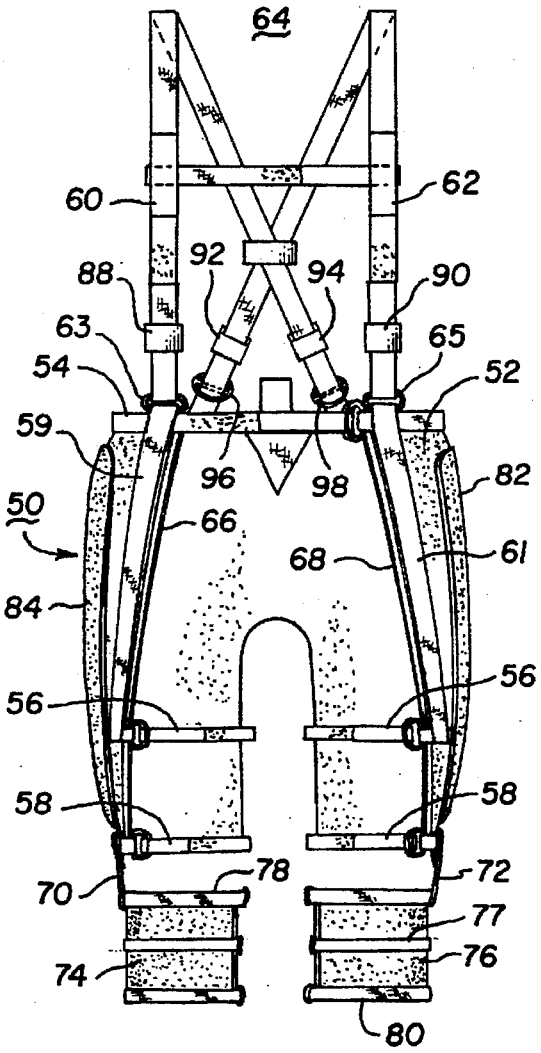
FIG. 6 is a front elevation of an alternative embodiment of the wearing apparel hereof.
Figure 7:
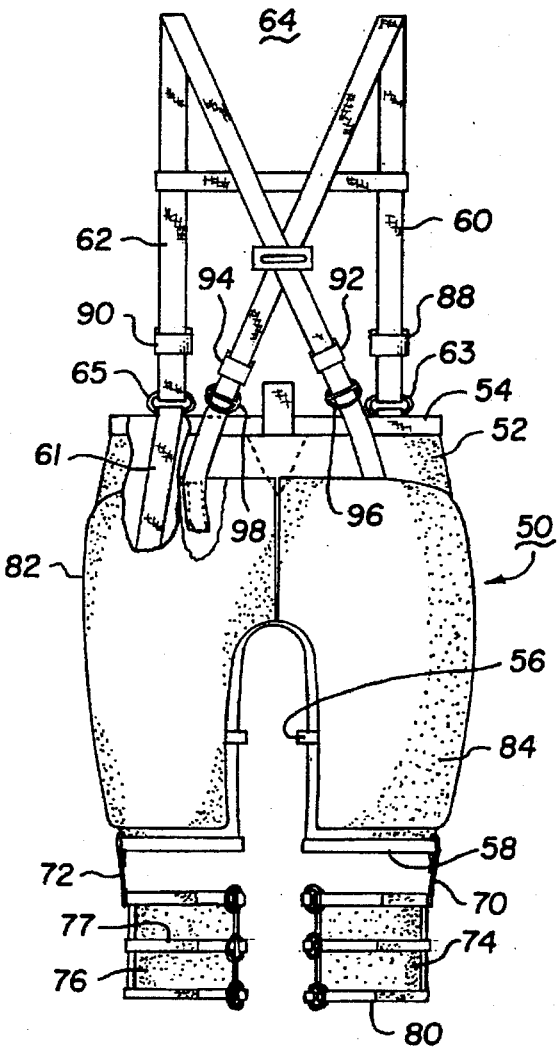
FIG. 7 is a rear elevation of the embodiment of FIG. 6.

In the description which follows, like parts are marked throughout the specification and drawings with the same reference numerals respectively. The drawing figures are not necessarily to scale and in certain views, parts may have been exaggerated for purposes of clarity.

Referring now to the drawings, there is illustrated in the embodiment of FIG. 1, a workman 10 sitting on a sloping roof 12 being installed. The safety wear in accordance hereof has been attached over the otherwise street clothes of the workman and is designated 14.

Referring also now to FIGS. 2–5, safety wear 14 is comprised of several separate sections and components including an upper buttocks section 16, depending calf pads 18 and 20, knee pads 22 and 24, a hammer loop 26, and a nail .pouch 28. A plurality of straps 30, 32, 34, 36 and 38 and/or VELCRO fasteners enable the individual sections and components to be secured about the section 16 in a selected orientation. The knee pads are preferably attached via VELCRO fastener strips 40 and 42 as are the hammer loop and nail pouch that can be interchanged in location for right or left hand users.

Except for the various belts, an optional nylon rear crotch 44 and edging 48, the remainder of the safety wear hereof is comprised of a thick, soft, resilient and coarse textured composition 46 such as foam rubber or a high density polyurethane foam. The thickness of composition 46 can vary but in a preferred embodiment is about one half to two inches in thickness depending on the material selection and/or the precise circumstances of contemplated use. Nylon edging 48 extending about composition 46 prevents edge fraying. Being relatively thick, composition 46 will not only provide a strong cushion effect to the user but the coarse texture provided thereby will afford a high coefficient of friction with respect to roof surface 12 so as to decrease the potential for slipping or slideage by the wearer.

Referring now to FIGS. 6–9 the alternative embodiment of safety wear designated 50, is comprised of a buttocks section 52 having a waist band 54 along with leg bands 56 and 58. Adjustable support straps 60 and 62 vertically extend above section 52 from front rings 63 and 65 to form a cross-over shoulder harness 64 affording shoulder support for the wearer thereof. Front buckles 88 and 90 along with rear buckles 92 and 94 and rings 96 and 98 enable adjustment to be effected. Lower straps 66 and 68 connect waist band 54 to leg bands 56/58 while lower straps 59 and 61 connect leg bands 56/58 to rings 63 and 65 respectively. Also connected to leg bands 58 are short straps 70 and 72 supporting calf sections 74 and 76 that can be secured onto the wearer via bands 77, 78 and 80. Bands 54, 56, 58, 77, 78 and 80 preferably include VELCRO fastener ends for easily securing and releasing the safety wear to and from the wearer.

Figure 8:
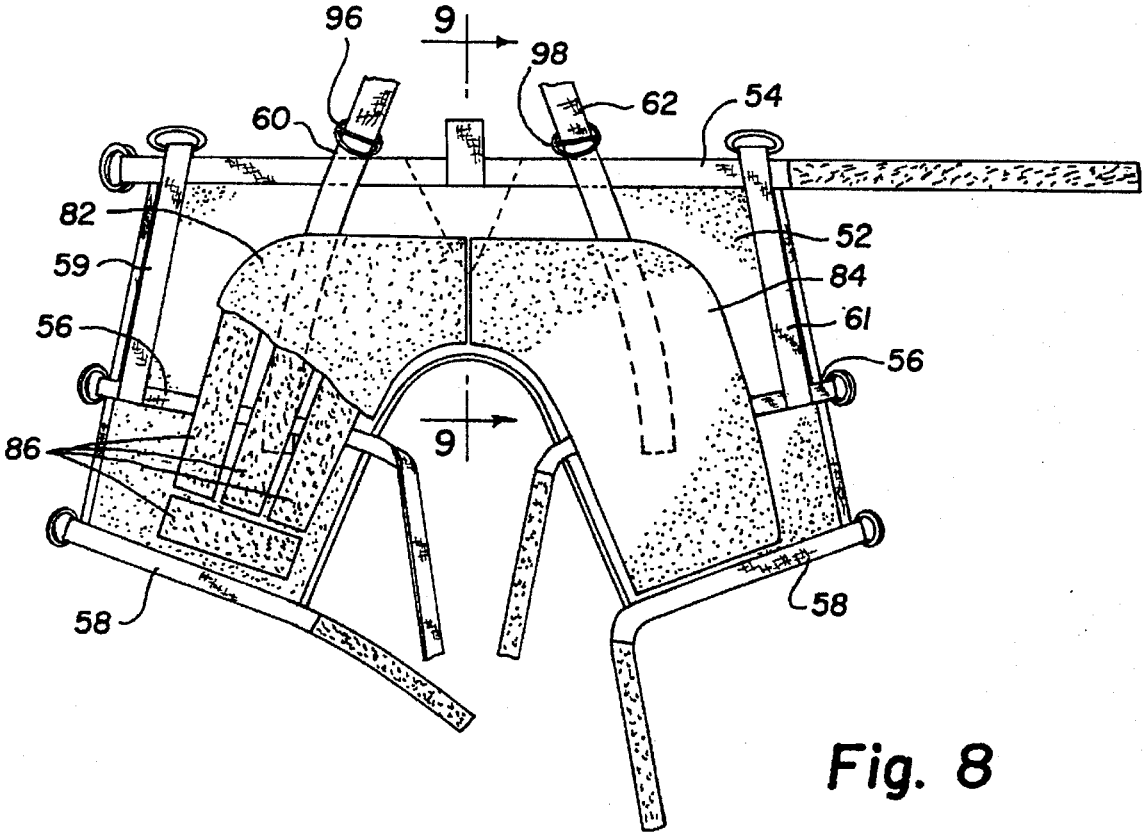
FIG. 8 is a fragmentary enlargement of the buttocks portion of FIG. 7.
Figure 9:
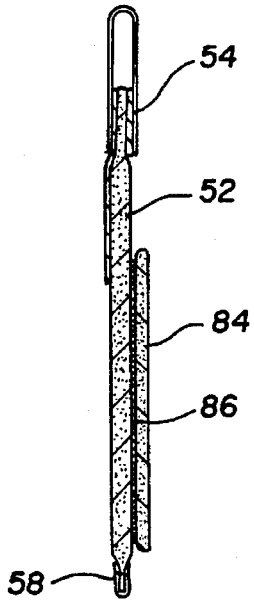
FIG. 9 is a sectional elevation as seen substantially from the position 9—9 of FIG. 8.

For enhancing skid resistance while affording increased life expectancy of the safety wear, the buttock section 52 is substantially encased by external pads 82 and 84. The pads are removeably secured to section 52 by a set of VELCRO fastener strips 86 (one set shown) as best seen in FIG. 8. In a preferred embodiment, the composition of both section 52 and the pads 82 and 84 can be the same as composition 46 described supra. Optionally, section 52 can be of a strong fabric composition such as Nylon, while the pads are of composition 46. In this arrangement, the knee and calf pads can conveniently be replaced as they become worn Likewise, harness 64 can be removed where not required or preferred.

By the above description there is disclosed novel construction of safety wear for workmen when installing or repairing a pitched roof so as to significantly reduce the potential for sliding and slippage from which serious injury could result. The article thereof is relatively simple in construction and relatively uncostly to fabricate. Being that the workman may from time to time desire to wear a more or less of the various sections and/or components, they are preferably marketed as a kit that can be assembled selectively on site in accordance with the user's preference. While simple in concept, the apparel hereof fulfills a long standing need in the industry in not only protecting the health of the wearer by minimizing the possibility of injury, but at the same time affords an economic benefit resulting from increased productivity of the user.

Since many changes could be made in the above construction and many apparently widely different embodiments of this invention could be made without departing from the scope thereof, it is intended that all matter contained in the drawings and specification shall be interpreted as illustrative and not in a limiting sense.

We claim:

1. Safety protective wear for a workman performing roof repair or installation on a sloped roof comprising:

at least one section pad of a thick, resilient composition having a coarse textured surface for engagement against a roof surface, and characterized as affording a high degree of slip resistance against the roof surface on which a workman is to perform;

said at least one section pad being dimensionally adapted to extend in a wrapped relation at least about the buttocks and rear thigh portions of a wearer; and securement means for securing said at least one section pad in said wrapped relation overlying at least the buttocks and rear of the wearer's thighs.

2. Safety protective wear in accordance with claim 1 in which said composition is at least ½ inch in thickness and is effective to produce a slip resistant coefficient of friction between the wearer and a roof surface at which the wearer is to perform.

3. Safety protective wear as recited in claim 2 in which said composition is of thickness in the range of between about one-half and two inches.

4. Safety protective wear in accordance with claim 3 in which said composition is selected from the group consisting of foam rubber and high density polyurethane foam.

5. Safety protective wear in accordance with claim 2 including first attachable sections adapted for optional rear wrap of each calf of said user and individually attachable to and detachable from said at least one section pad.

6. Safety protective wear in accordance with claim 5 including second attachable sections adapted for optional placement on a user's knees and individually attachable to and detachable from said at least one section pad.

7. Safety protective wear in accordance with claim 1 including a hammer loop attachable and detachable from said at least one section pad and in which a hammer can be toted by a wearer of said one section.

8. Safety protective wear in accordance with claim 1 including a nail pouch attachable and detachable from said at least one section pad and in which nails can be toted by a wearer of said at least one section pad.

9. Safety protective wear in accordance with claim 6 in which said at least one section pad and said first and second attachable sections are packaged and sold in kit form from which the wearer can select one or more of said sections that the wearer elects to be worn.

10. Safety protective wear in accordance with claim 9 in which said kit also includes a hammer loop and a nail pouch for attachment and detachment from said one section pad.

11. Safety protective wear for a workman performing roof repair or installation on a sloped roof comprising:

at least one section dimensionally adapted to extend in a wrapped relation at least about the buttocks and rear thigh portions of a wearer;

a pad detachably secured at the rear of said one section and comprised of a thick, resilient composition having a coarse textured surface for engagement against a roof surface and characterized as affording a high degree of slip resistance against a roof surface on which the workman is to perform; and securement means for securing said one section in said wrapped relation overlying at least the buttocks of the wearer.

12. Safety protective wear in accordance with claim 11 in which said at least one section and said pad are comprised of the same composition.

13. Safety protective wear in accordance with claim 11 in which said pad composition is at least ½ inch in thickness and is effective to produce a slip resistant coefficient of friction between the wearer and a roof surface on which the wearer is to perform.

14. Safety protective wear in accordance with claim 11 including a shoulder harness for supporting said protective wear on the wearer thereof.

15. Safety protective wear in accordance with claim 11 in which the composition of said pad is a selected from the group consisting of foam rubber and high density polyurethane foam.

16. Safety protective wear in accordance with claim 15 in which said securement means includes a plurality of vertically spaced releaseable bands for detachably securing select portions of said section onto a wearer.

17. Safety protective wear in accordance with claim 11 in which said at least one section also includes knee pads detachably secured thereto.

18. Safety protective wear in acordance with claim 11 in which said at least one section also includes calf pads detachably secured thereto.

* * * * *